US009986846B1

(12) United States Patent
Davis

(10) Patent No.: US 9,986,846 B1
(45) Date of Patent: Jun. 5, 2018

(54) SLIDE FASTENER

(71) Applicant: IDEAL Fastener Corporation, Oxford, NC (US)

(72) Inventor: Gary Davis, Oxford, NC (US)

(73) Assignee: IDEAL Fastener Corporation, Oxford, NC (US)

( * ) Notice: Subject to any disclaimer, the term of this patent is extended or adjusted under 35 U.S.C. 154(b) by 0 days. days.

(21) Appl. No.: 15/267,965

(22) Filed: Sep. 16, 2016

Related U.S. Application Data

(63) Continuation of application No. 14/508,510, filed on Oct. 7, 2014, now abandoned.

(60) Provisional application No. 61/889,554, filed on Oct. 11, 2013.

(51) Int. Cl.
*A44B 19/26* (2006.01)
*A47C 31/10* (2006.01)
*A44B 19/12* (2006.01)

(52) U.S. Cl.
CPC ..... *A47C 31/105* (2013.01); *A44B 19/12* (2013.01); *A44B 19/26* (2013.01)

(58) Field of Classification Search
CPC ..... A47C 31/105; A44B 19/382; A44B 19/26; A44B 19/34; A44B 19/60; Y10T 24/2509; Y10T 24/2502; Y10T 24/2593; Y10T 24/2504
See application file for complete search history.

(56) References Cited

U.S. PATENT DOCUMENTS 1,934,084 A * 11/1933 Murphy ..... A44B 19/04 2/234
1,952,506 A * 3/1934 Legat ..... A44B 19/386 24/433
2,191,963 A * 2/1940 London ..... A47C 31/105 297/228.1
2,296,358 A * 9/1942 Marinsky ..... E04H 15/32 135/119
2,400,731 A * 5/1946 Armstrong ..... A47C 27/006 150/154
2,442,105 A * 5/1948 Vacheron ..... A47G 9/066 2/1
2,519,012 A * 8/1950 Babcock ..... A44B 19/382 24/386
2,621,387 A * 12/1952 Williams ..... A44B 19/301 24/386

(Continued)

FOREIGN PATENT DOCUMENTS

JP 2002038321 A 2/2002

OTHER PUBLICATIONS

Information disclosure statement (IDS) letter regarding common patent application(s), dated Nov. 23, 2016.

*Primary Examiner* — Jason W San

(74) *Attorney, Agent, or Firm* — Tillman Wright, PLLC; Neal B. Wolgin; David R. Higgins

(57) ABSTRACT

Zippers with two sliders used for certain applications function better if the tooth pitch of the zipper teeth is extremely precise, and the pin/box assembly mounted to each end of the zipper is mounted so that the pins of each pin/box assembly are mounted on one zipper stringer and the boxes of each pin/box are mounted on the other zipper stringer. A zipper of such construction is well-suited for use in fastening a mattress cover, a boat cover, an automobile soft-top, and similar articles.

20 Claims, 3 Drawing Sheets

(56) References Cited

U.S. PATENT DOCUMENTS 2,622,248 A * 12/1952 Schaye ..... A41B 13/005 2/80
2,701,903 A * 2/1955 Williams ..... A44B 19/301 24/386
2,889,605 A * 6/1959 Morin ..... A44B 19/38 2/80
3,001,904 A * 9/1961 Porepp ..... A44B 19/34 156/66
3,081,462 A * 3/1963 Radovsky ..... A44B 19/60 2/265
3,225,429 A * 12/1965 Fady ..... A41H 37/06 24/383
3,287,749 A * 11/1966 Marsico ..... A47C 27/05 5/716
3,309,746 A * 3/1967 Carlile ..... A44B 19/36 24/383
3,456,306 A 7/1969 Heimberger
3,482,292 A 12/1969 Frohlich
3,488,239 A * 1/1970 Heimberger ..... A44B 19/38 156/196
3,872,551 A * 3/1975 Moertel ..... A44B 19/382 24/386
3,892,016 A * 7/1975 Brown ..... A44B 19/32 24/386
3,953,912 A * 5/1976 Fukuroi ..... A44B 19/36 24/383
4,099,301 A * 7/1978 Fujisaki ..... A44B 19/36 24/386
4,112,556 A * 9/1978 Flaum ..... A44B 19/24 190/903
4,123,829 A 11/1978 Takabatake
4,238,872 A * 12/1980 Akashi ..... A44B 19/382 156/66
4,388,738 A 6/1983 Wagner
4,492,006 A * 1/1985 Ishii ..... A44B 19/34 24/382
5,031,944 A 7/1991 Keyaki
5,136,741 A * 8/1992 Balonick ..... A47C 27/001 5/699
5,414,882 A * 5/1995 Goodale ..... A47C 31/105 2/86
5,628,093 A * 5/1997 Goodale ..... A44B 19/382 24/381
5,697,130 A * 12/1997 Smith ..... A44B 19/38 24/381
6,775,885 B1 * 8/2004 Wang ..... A44B 19/382 24/385
6,832,415 B2 * 12/2004 Higginbotham ..... A44B 19/24 24/381
6,966,090 B2 * 11/2005 McClintock ..... A47C 21/022 5/502
7,487,560 B2 * 2/2009 McGrath ..... A47C 21/022 5/484
7,506,417 B2 * 3/2009 Yoneoka ..... A44B 19/301 24/386
7,552,489 B2 * 6/2009 Bell ..... A47C 31/007 24/389
7,979,964 B2 * 7/2011 Jans ..... A44B 19/301 24/386
8,127,382 B1 * 3/2012 Plascencia ..... A47G 9/0238 5/490
8,347,430 B2 * 1/2013 Malouf ..... A47C 31/007 5/484
8,719,977 B2 * 5/2014 Rabbany ..... A47C 31/105 5/496
8,752,253 B2 * 6/2014 Sato ..... A44B 19/28 24/386
8,938,824 B2 * 1/2015 Rensink ..... A47C 31/007 5/482
8,997,263 B2 * 4/2015 Damon ..... A44B 19/38 2/96
9,601,034 B2 * 3/2017 Jensen ..... G09F 3/00
2003/0106157 A1 * 6/2003 Rugset ..... A47C 31/10 5/738
2004/0173133 A1 * 9/2004 Peng ..... A44B 19/34 112/475.16
2005/0132498 A1 * 6/2005 Vrionis ..... A47C 27/005 5/737
2005/0268438 A1 * 12/2005 Chung ..... A44B 19/262 24/386
2006/0042732 A1 * 3/2006 Oh ..... A45C 3/04 150/107
2007/0022579 A1 2/2007 Akashi et al.
2007/0113384 A1 * 5/2007 Ortlieb ..... A44B 19/26 24/385
2008/0196217 A1 * 8/2008 Eschbach ..... A44B 19/262 24/386
2009/0293198 A1 * 12/2009 Fodge ..... A47C 31/10 5/653
2010/0037438 A1 * 2/2010 Muratsubaki ..... A41F 1/008 24/429
2011/0232047 A1 * 9/2011 Ogura ..... A44B 19/382 24/386
2012/0102646 A1 * 5/2012 Chen ..... A44B 19/22 5/499
2012/0137434 A1 * 6/2012 Dusaj ..... A47C 31/007 5/499
2012/0151654 A1 * 6/2012 Chopak ..... A41B 13/06 2/69.5
2012/0255120 A1 * 10/2012 Poston ..... A47C 31/105 5/499
2012/0260468 A1 * 10/2012 Nozaki ..... A44B 19/382 24/386
2013/0269085 A1 * 10/2013 Damon ..... A44B 19/38 2/243.1
2014/0069757 A1 * 3/2014 Schlipper ..... A44B 19/06 190/113
2015/0223572 A1 * 8/2015 Wang ..... A44B 19/26 24/428
2015/0366313 A1 * 12/2015 Hsu ..... A45C 5/03 24/30.5 L
2016/0081437 A1 * 3/2016 Davis ..... A47C 31/105 5/488
2016/0128499 A1 * 5/2016 Jhou ..... A47G 9/0292 5/493
2016/0198812 A1 * 7/2016 Tan ..... A44B 19/22 24/389
2016/0331160 A1 * 11/2016 Rattner ..... A47G 9/04

* cited by examiner

SLIDE FASTENER

CROSS-REFERENCE TO RELATED APPLICATIONS

The present application is a U.S. continuation patent application of, and claims priority under 35 U.S.C. § 120 to, U.S. Non-Provisional patent application Ser. No. 14/508,510, filed Oct. 7, 2014, which '510 application is incorporated by reference herein, and which '510 application is a U.S. nonprovisional patent application of, and claims priority under 35 U.S.C. § 119(e) to, U.S. provisional patent application Ser. No. 61/889,554, filed Oct. 11, 2013, which provisional patent application is incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

Field of the Invention

The present invention relates generally to a slide fastener, or zipper, that includes features that allow the zipper to be used to facilitate the replacement of a mattress cover or the installation of a boat cover or a soft top for an automobile as well as other applications requiring very long zippers.

There are a number of applications for slide fasteners that incorporate two sliders rather than the more typical single slider. A zipper with two sliders simplifies the use of very long zippers in applications such as mattress covers, automobile soft-top covers, boat covers, and the like. In one application, the slide fastener of the present invention is used as a closure for a two-piece mattress cover that allows a top mattress cover to be easily removed for cleaning or replacement.

There are prior art single slider zippers that are used to fasten a mattress cover or a futon cover or large pillows and similar articles. Such zippers are typically used at the time of manufacture of the article in place of simply sewing such covers permanently closed. In some instances, a zipper is used to allow the cover to be removed or to allow access to the article's filling. In other instances, a zipper is used because the cover is sewn in one country (generally because labor costs are low), and then the empty cover is shipped flat to another country (where labor costs are higher) to be filled. In many instances, the retail consumer is located in the country where labor costs are higher. Manufacturing articles in this manner reduces shipping costs dramatically. In both instances, the zipper is often intended to be used only once in the lifetime of the article, and the zipper may comprise a very low quality slider and pull tab since repeated use is not intended. Therefore, a need exists for improvement in the field of zippers for mattress covers and similar articles that address the shortcomings of the prior art. This and other needs are addressed by one or more aspects of the present invention.

Description of Related Art

A typical prior art zipper that is used with a mattress cover is made in a manner that emphasizes the closing (lateral)

strength of the zipper, but not necessarily the ability to use the zipper after it is first closed during the manufacture of the mattress or similar article. Such zippers have good lateral strength, which means that the teeth on the opposing zipper tapes (stringers) remain fully engaged and resist separating during the life of the mattress. However, in order to keep the cost of such a zipper low, the zipper may have a single low quality slider and pull tab. At the time of the manufacture of the mattress assembly, the mattress itself is placed on the bottom half of the cover, the top half of the cover is pulled over the mattress, and the zipper slider is engaged and closed. The fit is generally tight, and may be very tight, so the mattress cover fits snugly. The tight fight of a zipper in such an application requires precise alignment of the mattress cover halves and the use of some skill in order to properly close the zipper. Since the zipper is only used at the time of manufacture of the mattress assembly, such limitations are not onerous since the mattress manufacturer will ensure that the mattress cover zipper is properly closed before the mattress leaves the factory.

Therefore, it is an objective of the present invention to create a slide fastener that is easy to use by a consumer, and that may be operated multiple times over the lifetime of the mattress.

SUMMARY OF THE INVENTION

The zipper of the present invention accomplishes the above objectives as described below.

In one embodiment of the present invention, the slide fastener comprises two sliders positioned top-to-top (the tops of the sliders touch when in the fashioned position), and a pin/box assembly on each end of the tapes. This is different than the more common type of zipper with two sliders where the sliders are positioned so that the bottoms touch. This more common type of zipper with two sliders is commonly used for outerwear, allowing the article to be fully zippered closed, but then also allowing the lower slider to be moved upwards thereby allowing a wearer to sit more comfortably, and or the upper slider to be moved downwards to allow a wearer to cool off. In the case of the slide fastener of the present invention with two sliders, the pin of each pin/box assembly is mounted on one of the zipper stringers, and the box of each pin/box assembly is mounted on the other zipper stringer. In the more common outerwear example, there is a pin/box assembly at the bottom end of the zipper and top stops on the top end. In one application of the present invention, the stringer with both boxes is sewn to the bottom half of a two-piece mattress cover, and the stringer with both pins is sewn to the top half of the mattress cover. In this application, mounting both boxes to the one stringer sewn to the bottom half of the cover prevents the sliders from being removable. In addition, the one stringer that has both pins mounted to each end of that stringer allows the top half of a mattress to be easily removed by a consumer. Further, because the stringer sewn to the top half of the mattress cover retains neither slider, it is easier to launder the top half of the mattress cover.

A prior art single-slider zipper used to close a mattress cover presents additional operational difficulties to a retail consumer. Depending on where the bottom stop of such a zipper is sewn relative to the corners of the mattress, it may be very difficult for a retail consumer to operate the zipper. For instance, if the bottom stops are mounted to a corner, it may be very difficult to align the stops to engage the zipper teeth. Further, if the mattress fits snugly in a bed frame, or the bed frame is against a wall, the retail consumer may have to tilt the mattress up or pull the mattress away from the wall in order to access the zipper slider.

In contrast, the two sliders on the zipper of the present invention may be moved to any desirable position around the periphery of the mattress. This allows the retail consumer to open the zipper easily by moving each of the sliders independently.

BRIEF DESCRIPTION OF THE DRAWINGS

One or more preferred embodiments of the present invention now will be described in detail with reference to the accompanying drawings, wherein the same elements are referred to with the same reference numerals.

DETAILED DESCRIPTION

Figure 1:
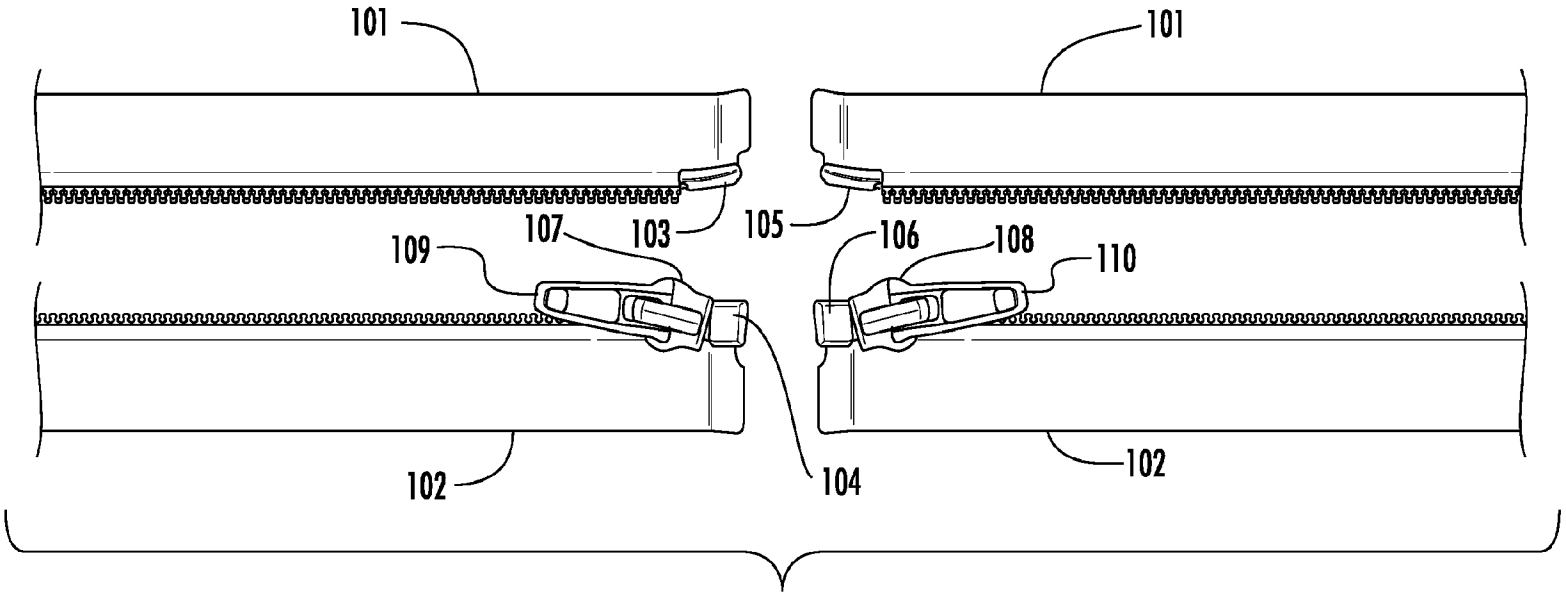
FIG. 1 is an illustration of an unfastened slide fastener of the present invention showing the ends of the stringers and the sliders.

As a preliminary matter, it will readily be understood by one having ordinary skill in the relevant art (an "Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended to, nor is to be construed to, limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

In a preferred embodiment of the present invention, the slide fastener teeth are coil-type teeth. In order to make a slide fastener of the present invention, the pitch of the slide fastener teeth must be extremely precise. This is necessary for two reasons. For a coil-type slide fastener, the zipper chain is formed by feeding two identical zipper tapes into a coil-forming machine where two polyester mono-filaments are formed into spirals and then simultaneously sewn to the two tapes, resulting in two zipper stringers that are engaged at the exit of the coil-forming machine. The two engaged zipper stringers are collectively referred to as zipper chain. The zipper chain used in the zipper of the present invention is then gapped wherein some length of teeth are removed, and the gapped sections are laminated. Sliders are mounted through the gapped section, and pin/box assemblies are mounted at each end of the gapped section of chain. The laminated section of the tape is then cut to length to make each slide fastener from the finished chain. In one application of the zipper of the present invention, the top half of the mattress cover is replaced with a new top cover. In order for the new top half of the mattress cover to work properly with the existing bottom half, the teeth of the zipper stringer of the new top cover must have the exact same pitch as the bottom half in order to properly mate.

Referring now to the drawings, one or more preferred embodiments of the present invention are next described. The following description of one or more preferred embodiments is merely exemplary in nature and is in no way intended to limit the invention, its implementations, or uses.

FIG. 1 is an illustration of an unfastened slide fastener of the present invention showing the ends of the stringers and the sliders. The zipper chain of the zipper comprises stringer 101 and stringer 102. Stringer 101 is terminated at each end with a pin 103 of a pin/box assembly at one end, and a pin 105 of a pin/box assembly at the other end. Stringer 102 is terminated at each end with a box 104 of a pin/box assembly at one end, and a box 106 of a pin/box assembly at the other end. A slider 107 and a slider 108 are mounted to stringer 102 before boxes 104 and 106 are mounted to stringer 102. Sliders 107 and 108 are mounted so that the bottom of the slider 107 is adjacent to box 104, and so that the bottom of the slider 108 is adjacent to box 106 when the zipper is fully opened (unfastened). Slider 107 is operated by pull tab 109, and slider 108 is operated by pull tab 110.

Figure 2:
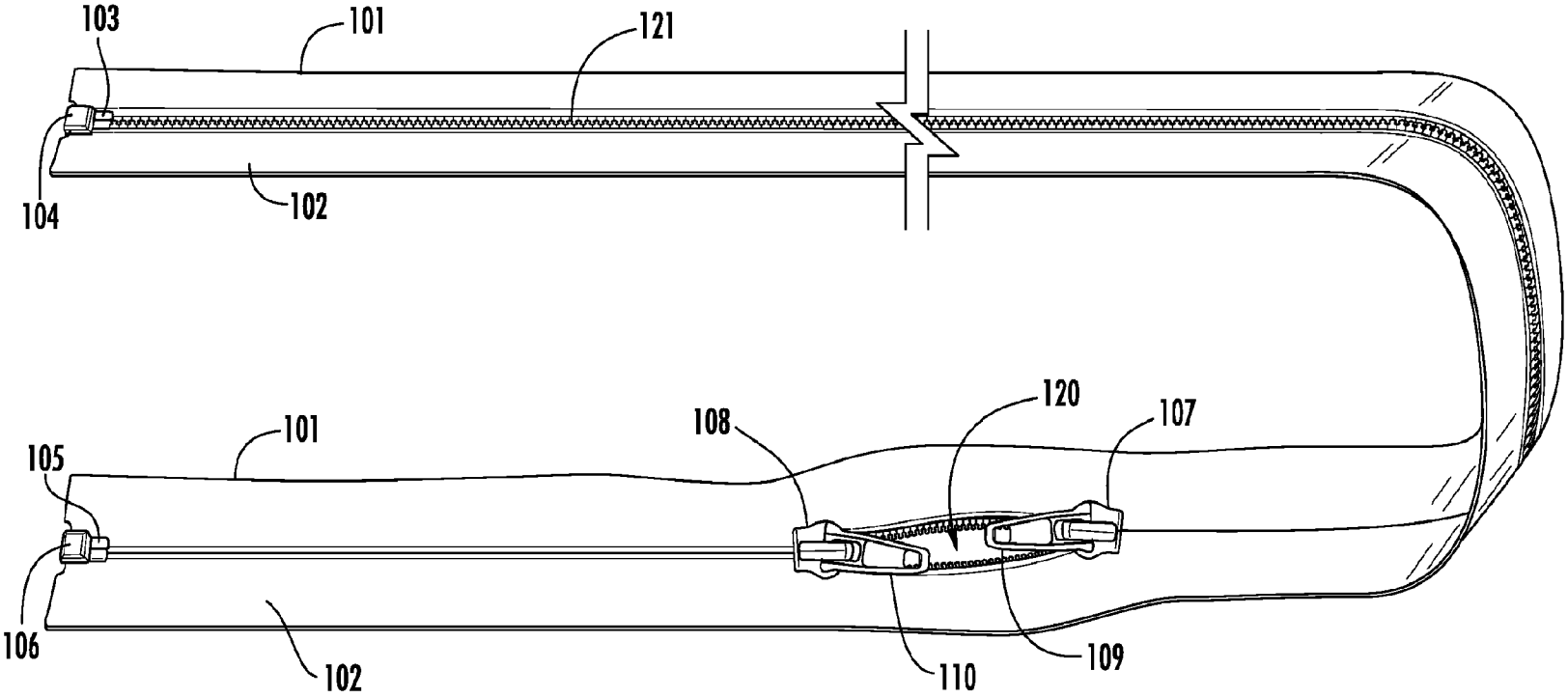
FIG. 2 is an illustration of a fastened slide fastener of the present invention showing the ends of the stringers and the sliders.

FIG. 2 is an illustration of a fastened slide fastener of the present invention showing the ends of the stringers and the sliders. The pin 103 of stringer 101 is inserted into box 104 of stringer 102, and in a similar manner pin 105 of stringer 101 is inserted into box 106 of stringer 102. The slider fastener as illustrated is substantially closed, with the tops of sliders 107 and 108 in close proximity. The gap 120 between the tops of the sliders may be moderately small, with the pull tabs 109 and 110 overlapping, or very small with the tops of sliders 107 and 108 touching and pull tabs 109 and 110 folded back over their respective sliders. Zipper teeth 121 are shown on the back side of the stringers, and are not visible when the slide fastener of the present invention is fastened (closed). If the stringer 101 is sewn to a replacement mattress cover (not the original cover), then stringer 101 will have been formed from a different piece of zipper chain than stringer 101 and 102 of the original slide fastener. If the pitch of the coil teeth of replacement stringer 101 is not precisely the same as the pitch of the teeth of original stringer 102, the slide fastener may not work at all, or may operate poorly, and the resulting gap 120 can leave a mismatch that results in a puckering of the stringers. This would be unacceptable to a consumer.

Figure 3:
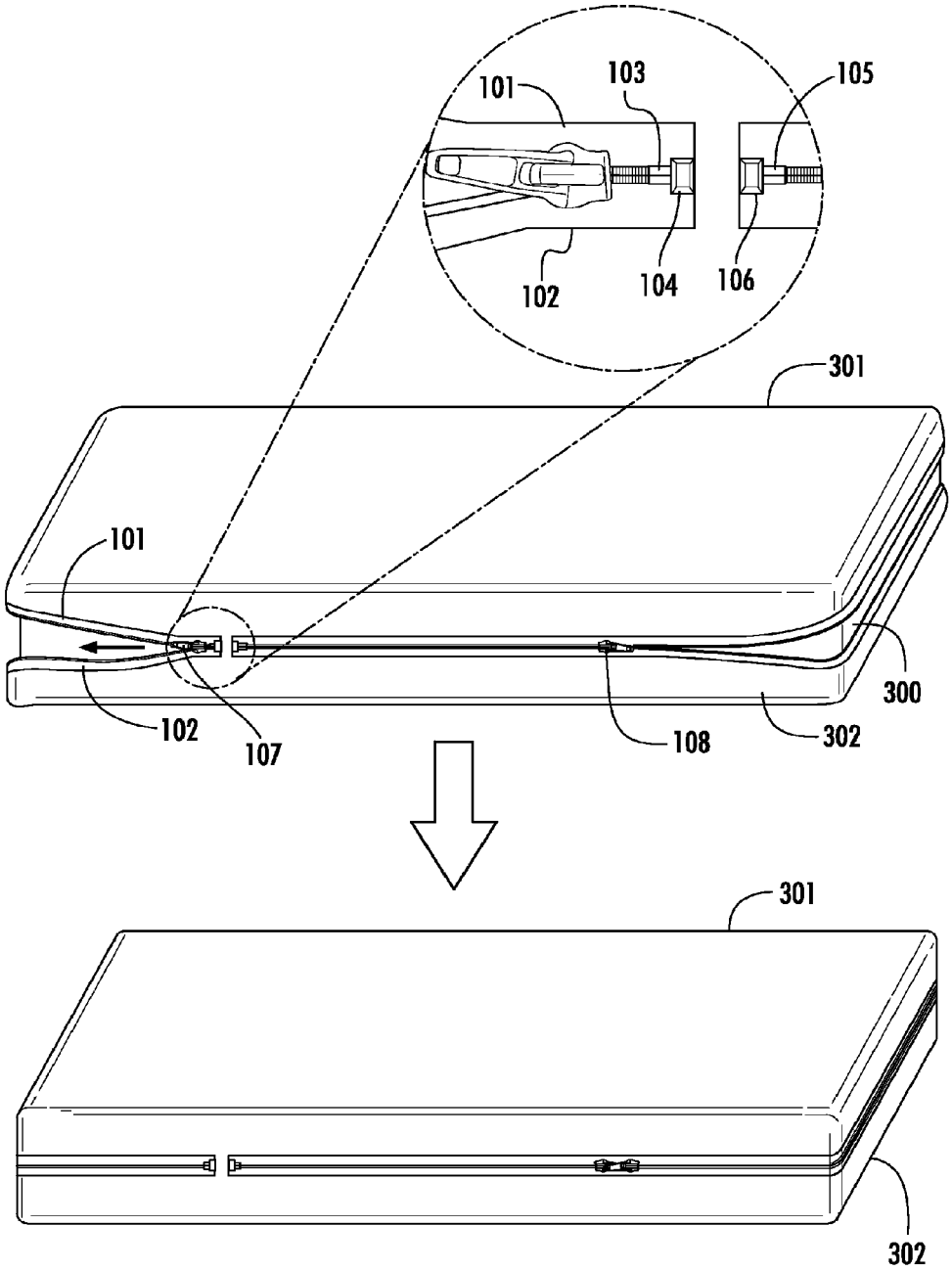
FIG. 3 is an illustration of a mattress enveloped by a mattress cover that incorporates the slide fastener of the present invention.

FIG. 3 is an illustration of a mattress enveloped by a mattress cover that incorporates the slide fastener of the present invention. Mattress 300 is positioned on top of mattress cover bottom half 302, and mattress cover top half 301 is placed on top of the mattress 300. Slide fastener stringer 102 is sewn to mattress cover bottom half 302, and slide fastener stringer 101 is sewn to mattress cover top half 301. The pin 103 of stringer 101 is inserted into box 104 of tape 102, and in a similar manner pin 105 of stringer 101 is inserted into box 106 of stringer 102. Viewing mattress 300 from above as shown in FIG. 3, slider 107 is then pulled by pull tab 109 in a clockwise direction, and slider 108 is then pulled by pull tab 110 in a counter-clockwise direction, until the sliders meet. When the sliders meet, the slide fastener illustrated is closed. In order to remove mattress cover top half 301, the above closing process is reversed. With the mattress cover top half 301 removed, it can be laundered or replaced with a substitute mattress cover top half 301. Note that sliders 107 and 108 may be "parked" in any convenient location around the periphery of the mattress as desired by the zipper operator.

What is claimed is:

1. A method for fastening a cover around a mattress, the method comprising:

providing a first cover portion having a first zipper stringer attached along an edge thereof, the first zipper stringer including a first row of zipper teeth, a first pin attached at a first end thereof, and a second pin attached at a second end thereof;

arranging a mattress over the first cover portion;

arranging a second cover portion over the mattress, the second cover portion having a second zipper stringer attached along an edge thereof, the second zipper stringer including a second row of zipper teeth, a first box attached at a first end thereof, a second box attached at a second end thereof, and first and second sliders secured along the second row of zipper teeth;

positioning the first pin of the first cover portion through the first slider and into the first box of the second cover portion;

positioning the second pin of the first cover portion through the second slider and into the second box of the second cover portion;

manipulating one or both of the first and second sliders to bring the second row of zipper teeth into interlocked arrangement with the first row of zipper teeth, thereby securing respective edges of the first and second cover portions together and entirely enveloping the mattress between the first and second cover portions;

manipulating one or both of the first and second sliders to bring the second row of zipper teeth out of interlocked arrangement with the first row of zipper teeth, thereby unsecuring respective edges of the first and second cover portions from one another;

removing the second cover portion; and replacing the second cover portion with a replacement second cover portion.

2. The method of claim 1, further comprising, after manipulating one or both of the first and second sliders to bring the first and second rows of zipper teeth into interlocked arrangement, arranging a pull tab of the first slider in close proximity or in abutment with a pull tab of the second slider.

3. The method of claim 1, further comprising:

sewing the first zipper stringer to the first cover portion; and sewing the second zipper stringer to the second cover portion.

4. The method of claim 1, wherein the first row of zipper teeth includes a tooth pitch that matches a tooth pitch of the second row of zipper teeth.

5. The method of claim 1, wherein the first and second rows of zipper teeth each include coil-type teeth.

6. The method of claim 1, wherein:

the first row of zipper teeth is coextensive with a length of the first zipper stringer; and the second row of zipper teeth is coextensive with a length of the second zipper stringer.

7. The method of claim 1, wherein the replacement second cover portion includes a replacement second row of zipper teeth, the replacement second row of zipper teeth having a tooth pitch that matches the tooth pitch of the first row of zipper teeth.

8. The method of claim 1, wherein the first and second rows of zipper teeth are arranged along an interior-facing side of the respective zipper stringers such that the first and second rows of zipper teeth are not visible when the first and second cover portions are secured to one another.

9. A method for fastening a cover around a mattress, the method comprising:

providing a first cover portion having a first zipper stringer attached along an edge thereof, the first zipper stringer including a first row of zipper teeth, a first pin attached at a first end thereof, and a second pin attached at a second end thereof;

arranging a mattress over the first cover portion;

arranging a second cover portion over the mattress, the second cover portion having a second zipper stringer attached along an edge thereof, the second zipper stringer including a second row of zipper teeth, a first box attached at a first end thereof, a second box attached at a second end thereof, and first and second sliders secured along the second row of zipper teeth;

positioning the first pin of the first cover portion through the first slider and into the first box of the second cover portion;

positioning the second pin of the first cover portion through the second slider and into the second box of the second cover portion;

manipulating one or both of the first and second sliders to bring the second row of zipper teeth into interlocked arrangement with the first row of zipper teeth, thereby securing respective edges of the first and second cover portions together and entirely enveloping the mattress between the first and second cover portions;

manipulating one or both of the first and second sliders to bring the second row of zipper teeth out of interlocked arrangement with the first row of zipper teeth, thereby unsecuring respective edges of the first and second cover portions from one another;

removing the first cover portion; and replacing the first cover portion with a replacement first cover portion.

10. The method of claim 9, wherein the replacement first cover portion includes a replacement first row of zipper teeth, the replacement first row of zipper teeth having a tooth pitch that matches the tooth pitch of the second row of zipper teeth.

11. The method of claim 9, further comprising, after manipulating one or both of the first and second sliders to bring the first and second rows of zipper teeth into interlocked arrangement, arranging a pull tab of the first slider in close proximity or in abutment with a pull tab of the second slider.

12. The method of claim 9, wherein the first row of zipper teeth includes a tooth pitch that matches a tooth pitch of the second row of zipper teeth.

13. The method of claim 9, wherein the first and second rows of zipper teeth each include coil-type teeth.

14. The method of claim 9, wherein the first and second rows of zipper teeth are arranged along an interior-facing side of the respective zipper stringers such that the first and second rows of zipper teeth are not visible when the first and second cover portions are secured to one another.

15. A method for fastening a cover around a mattress and subsequently replacing a portion thereof, the method comprising:

providing a first cover portion having a first zipper stringer attached along an edge thereof, the first zipper stringer including:

a first row of zipper teeth that is coextensive with a length of the first zipper stringer, a first pin attached at a first end thereof, and a second pin attached at a second end thereof;

arranging a mattress over the first cover portion;

arranging a second cover portion over the mattress, the second cover portion having a second zipper stringer attached along an edge thereof, the second zipper stringer including:

a second row of zipper teeth that is coextensive with a length of the second zipper stringer, a first box attached at a first end thereof, and a second box attached at a second end thereof, the first and second ends of the second zipper stringer being disposed in an end-to-end relationship such that the first box is adjacent the second box, and first and second sliders secured along the second row of zipper teeth;

positioning the first pin of the first cover portion through the first slider and into the first box of the second cover portion;

positioning the second pin of the first cover portion through the second slider and into the second box of the second cover portion;

manipulating one or both of the first and second sliders to bring the second row of zipper teeth into interlocked arrangement with the first row of zipper teeth, thereby securing respective edges of the first and second cover portions together; and arranging a pull tab of the first slider in close proximity or in abutment with a pull tab of the second slider;

wherein the first and second rows of zipper teeth each include coil-type teeth.

16. The method of claim 15, further comprising:

sewing the first zipper stringer to the first cover portion; and sewing the second zipper stringer to the second cover portion.

17. The method of claim 15, wherein the first row of zipper teeth includes a tooth pitch that matches a tooth pitch of the second row of zipper teeth.

18. The method of claim 15, wherein the first and second rows of zipper teeth are arranged along an interior-facing side of the respective zipper stringers such that the first and second rows of zipper teeth are not visible when the first and second cover portions are secured to one another.

19. The method of claim 15, further comprising:

manipulating one or both of the first and second sliders to bring the second row of zipper teeth out of interlocked arrangement with the first row of zipper teeth, thereby unsecuring respective edges of the first and second cover portions from one another;

removing the second cover portion; and replacing the second cover portion with a replacement second cover portion.

20. The method of claim 15, further comprising:

manipulating one or both of the first and second sliders to bring the second row of zipper teeth out of interlocked arrangement with the first row of zipper teeth, thereby unsecuring respective edges of the first and second cover portions from one another;

removing the first cover portion; and replacing the first cover portion with a replacement first cover portion.

* * * * *